United States Patent [19]

Kaplan et al.

[11] 4,074,383

[45] Feb. 21, 1978

[54] LASTING MACHINE WITH LATEX ADHESIVE DELIVERY

[75] Inventors: Martin Kaplan, Lexington; Joseph V. Tassone, Milford, both of Mass.

[73] Assignee: Compo Industries, Inc., Waltham, Mass.

[21] Appl. No.: 778,504

[22] Filed: Mar. 17, 1977

[51] Int. Cl.[2] ..... A43D 21/00

[52] U.S. Cl. ..... 12/145; 12/8.3

[58] Field of Search ..... 12/145, 8.3

[56] References Cited

U.S. PATENT DOCUMENTS

| | | | |
|---|---|---|---|
| 2,607,936 | 8/1952 | Kamborian | 12/8.3 |
| 2,676,345 | 4/1954 | Kamborian | 12/8.3 |
| 3,315,288 | 4/1967 | Forma | 12/145 |

*Primary Examiner*—Patrick D. Lawson

*Attorney, Agent, or Firm*—Dike, Bronstein, Roberts, Cushman & Pfund

[57] ABSTRACT

The method of lasting footwear with liquid latex comprising depositing the latex in a wet, liquid, low-viscosity, nonadhesive form on the surface of the feed roll, of a pair of cooperating feed rolls of a progressive-type lasting machine, which normally has contact with the inner side of the lasting margin of the upper material at a place apart from the lasting margin, while the deposited latex is traveling from the place of deposit on the surface of the feed roll having contact with the inner side of the lasting margin to the place of contact with the lasting margin, spreading it uniformly thereon and rendering it partially coagulated and adhesive, transferring the partially coagulated adhesive latex to the lasting margin at the place of contact and, as the latex-coated surface of the lasting margin is released, pressing it against the latex-receptive surface of the insole, and apparatus for carrying out the method.

23 Claims, 9 Drawing Figures

LASTING MACHINE WITH LATEX ADHESIVE DELIVERY

BACKGROUND OF THE INVENTION

Conventionally, rubber footwear such as athletic shoes, tennis shoes, sneakers and the like are made by applying liquid latex to the lasting margin of any upper material which, in this case, is generally a woven fabric, allowing it to dry so as to become adhesive and then lasting the precoated upper to the insole, the bottom surface of which is receptive to latex. Usually, the insole is a laminate of fabric and unvulcanized rubber and it is to the latter surface that the precoated lasting margin of the upper is lasted. In lieu of a laminated insole of the foresaid kind, an insole of any material may be used coated on the side to which the lasting margin is to be lasted with a rubber cement which is allowed to dry before the lasting operation. The liquid latex is applied to the lasting margin of the upper and the rubber cement to the surface of the insole, if the latter requires it, by brushing or by means of a so-called top cementer. After coating, the upper material must be hung up to dry and the insoles stacked on edge to dry. The procedure is time-consuming, dirty and, due to carelessness and the pressure of processing as many as possible in a given time, the lasting margin of the upper and/or the margin of the insole may be incompletely covered or there may be thinly covered areas which will not hold when lasted. To lessen the handling time and rid the process of defects due to careless coating operations, attempts have been made to adapt the progressive-type lasting machine to lasting with latex by supplying the latex to the lasting margin of the upper or to the margin of the insole or to both just before the lasting margin is laid down by the wiping instrumentalities; however, such attempts were unsuccessful principally because of the nature of the latex. If the latex is supplied by a nozzle or applicator roll of a progressive-type lasting machine in a sufficiently liquid state to be dispensed by the nozzle without clogging the nozzle or to the surface of the applicator roll without premature coagulation and balling on the applicator roll, it will not set up fast enough when ultimately applied to the lasting margin to make a good bond. If, however, it is supplied in a sufficiently adhesive condition to the nozzle or applicator roll so that when applied to the lasting margin, a good bond would be formed, the latex will not run freely through the nozzle and, hence, plug the nozzle and would ball up on the applicator roll, both conditions requiring that the machine be stopped almost every operation for cleaning. While it is possible to last with hot melt, quick-drying adhesive, the cost is prohibitive and the operation is hazardous because of the high temperature necessary to keep the adhesive liquid. In our application Ser. No. 529,458, filed Dec. 4, 1974, there is described a method and apparatus for lasting with liquid latex to latex-receptive material which was partially successful. This invention relates to improvements in the aforesaid method and application which enables successful lasting of uppers to latex-receptive insoles with the use of a progressive-type lasting machine modified as will be described herein, thus eliminating the disadvantages of precoating operations and the time-consuming operations attendant thereon.

SUMMARY OF THE INVENTION

The method of lasting the upper material of footwear, especially canvas uppers, to insoles receptive to latex adhesive with liquid latex which comprises progressively and uninterruptedly stretching successive increments of the lasting margin of the upper material perpendicular to the insole with the aid of a pair of oppositely turning gripping and feeding rolls, one of which has contact with the inner side of the lasting margin and the other with the outer side of the lasting margin and, following such stretching, releasing the stretched increments and pressing them into engagement with the insole with the aid of wiping instrumentalities, said method further comprising providing an insole which has a latex-receptive surface, continuously delivering wet liquid latex onto the rotating surface of the feed roll having contact with the inner side of the lasting margin at approximately two-thirds of the way around from the place of stretching in the opposite direction from rotation for transfer from the place of delivery to the lasting margin at the place of stretching, directing a jet of air toward the surface of the feed roll having contact with the inner side of the lasting margin at a place substantially one-quarter of the way around from the place of stretching in the opposite direction from rotation at a pressure such as to spread the wet liquid on the surface uniformly and at a temperature such as to cause it to be partially coagulated and become adhesive at the place of stretching, pressing the partially coagulated adhesive layer of latex into engagement with the lasting margin and, as the latex-coated margin is released, pressing it into engagement with the latex-receptive surface of the insole. The wet latex is preferably gravitationally delivered to the surface of the feed roll in liquid, nonadhesive form and at a low viscosity. The air pressure is supplied to the hot air nozzle at about 5 lbs. per square inch and is projected onto the surface of the feed roll at about 300° F. The jet of air is projected toward the surface of the feed roll at an angle such that at least a portion is deflected toward the lasting margin and the feed roll having contact with the outer side of the lasting margin. The insole must have a latex-receptive surface provided by forming the insole of a laminate of fabric and uncured rubber or fiberboard coated with a layer of rubber cement and dried.

The apparatus by means of which the method is carried out comprises a pair of oppositely turning work gripping and feeding rolls of oppositely tapering frustoconical configuration supported for rotation about spaced parallel axes with their frustoconical surface closely spaced to receive between them the lasting margin, said gripping and feeding rolls being arranged so that the roll having the downwardly divergent frustoconical surface has contact with the inner side of the lasting margin and fixed and rotating wipers at the delivery side of the gripping and feeding rolls for folding the lasting margin down as it is released from the gripping and feeding rolls and for pushing the folded margin inwardly parallel to the bottom of the insole, providing the said apparatus with first nozzle means for gravitationally delivering wet, liquid, nontacky, nonadhesive latex of low viscosity onto the surface of the rotating feed roll having the downwardly divergent surfact at a position substantially two-thirds of the way around the roll from the place of contact of the roll with the lasting margin and with second nozzle means arranged to project air toward the surface of the feed roll having the downwardly divergent surface at a predetermined pressure and temperature so as to spread the adhesive on the surface of the latter feed roll as it approaches the lasting margin in a uniformly thick layer and to initiate partial coagulation and adhesiveness so that, at the place of contact, it becomes completely transferred to the lasting margin in a condition of adhesiveness when released for wiping into engagement with the latex-receptive surface of the insole. There is means for adjusting the position of the first nozzle means relative to the upper and lower ends of the feed rolls and means for adjusting the angle of the second nozzle means to effect projection of the air at an angle such that a portion at least of the heated air is deflected by the surface of the downwardly divergent feed roll toward the surface of the upwardly divergent feed roll and the lasting margin between the rolls.

The invention will not be described in greater detail with reference to the accompanying drawings, wherein.

Figure 4:
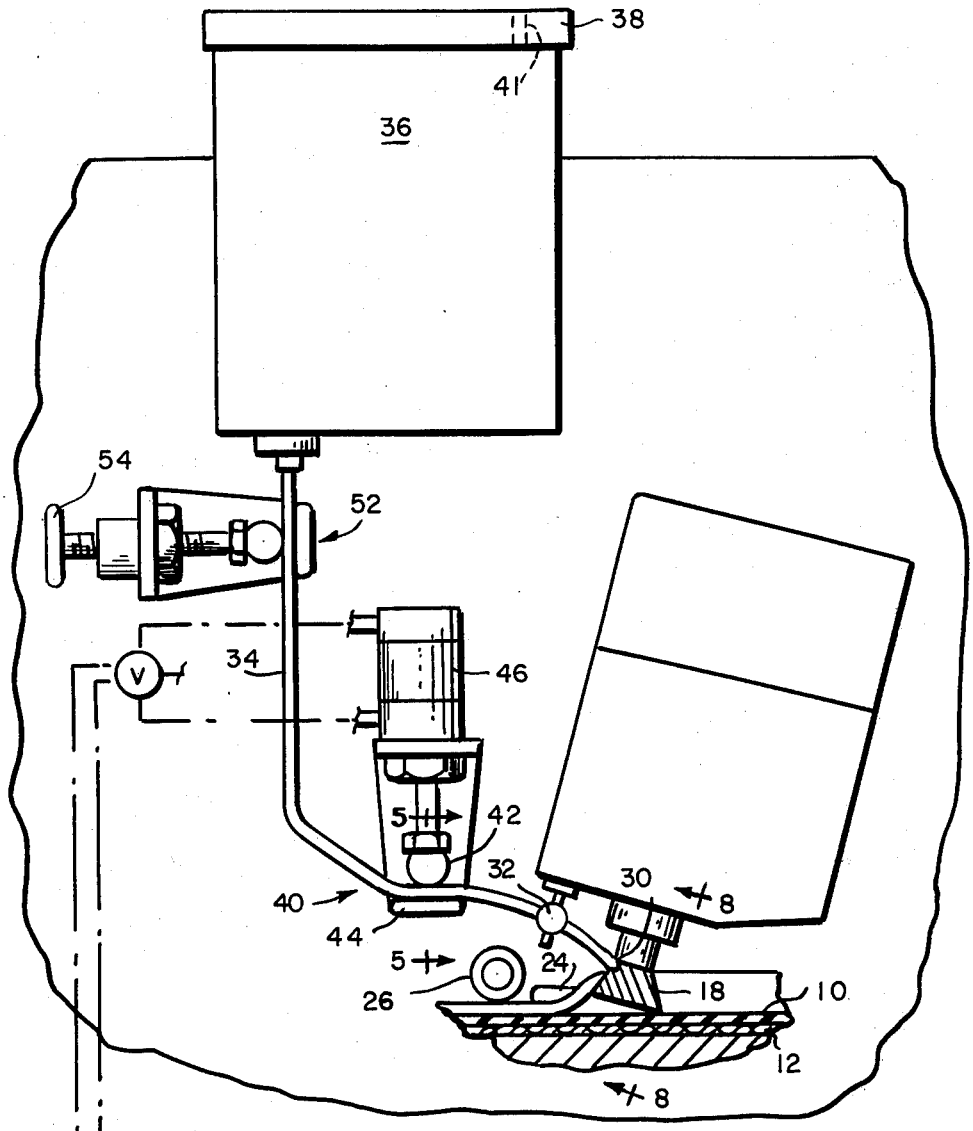
Figure 1:
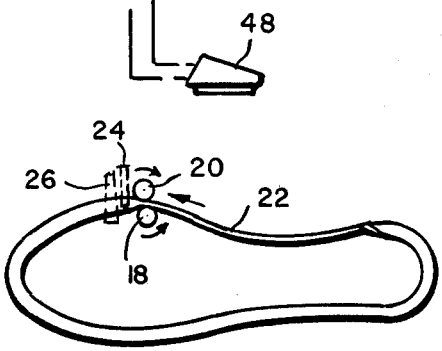
FIG. 1 is a plan view of the bottom of the last with an upper and insole mounted therein showing diagrammatically the cooperating gripping and feeding rolls by means of which the lasting margin is stressed heightwise of the bottom and the wiping instrumentalities by means of which the stressed margin is laid down against the insole following release from the gripping and feeding rolls.
Figure 2:
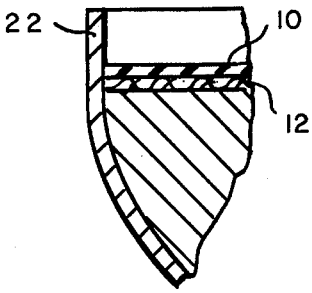
FIG. 2 is a fragmentary section taken transversely of the last showing an insole on the bottom of the last, an upper on the top side of the last, and the upwardly projecting lasting margin before it is laid down.
Figure 3:
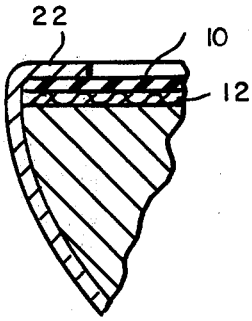
FIG. 3 is a view similar to FIG. 2 showing the lasting margin laid down on the insole.
Figure 5:
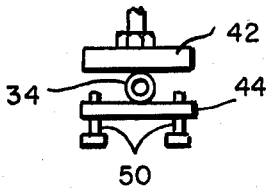
Figure 6:
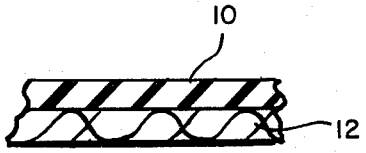
Figure 7:
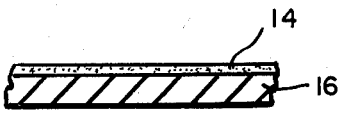

FIG. 4 shows a progressive-type laster in which there are a pair of oppositely rotating frustoconical feed rolls for stressing the lasting margin heightwise of the bottom and fixed and rotary wipers for laying the stressed lasting margin inwardly against the insole, equipped with means for supplying wet liquid latex adhesive to the surface of the feed roll having contact with the inner side of the lasting margin and with means for spreading the wet liquid latex on the surface of the feed roll and initiating partial coagulation and adhesiveness;

FIG. 5 is an elevation on the line 5—5 of FIG. 4 showing a treadle controlled off and on valve for stopping and starting the flow of latex;

FIG. 6 is a section of a laminate of a layer of fabric and a layer of uncured rubber from which the insoles may be die-cut;

FIG. 7 is a section of an insole material provided with a dried coating of rubber cement from which insoles may be die-cut.

Figure 8:
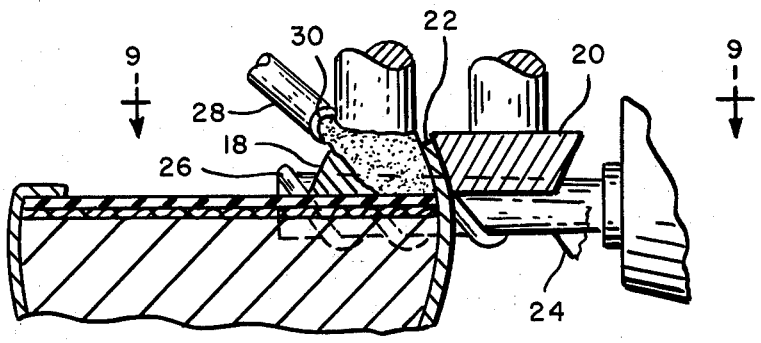
Figure 9:
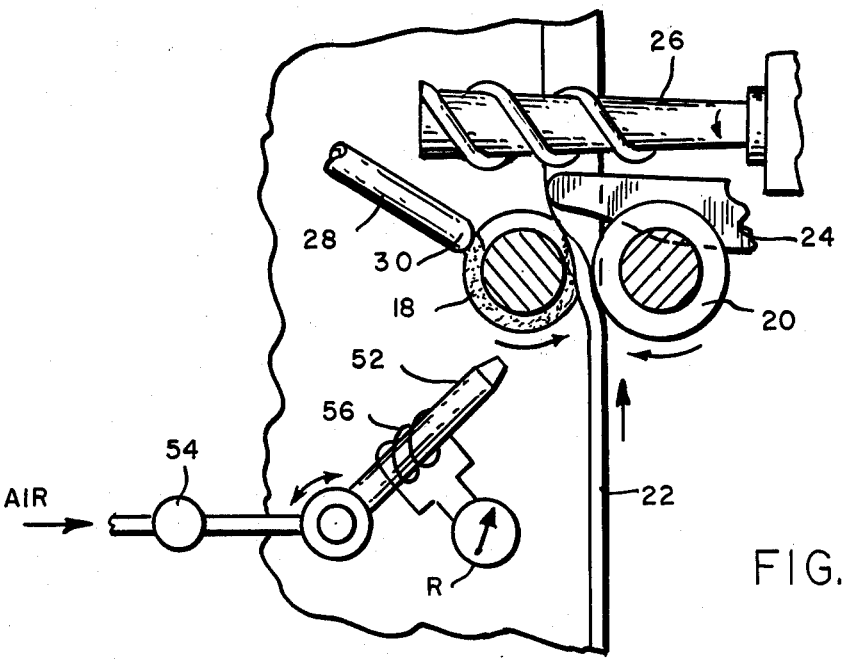

FIG. 8 is an enlarged fragmentary section taken on the line 8—8 of FIG. 4; and FIG. 9 is an elevation taken on the line 9—9 of FIG. 8.

As related heretofore, there are two problems which make it very difficult to use latex for lasting, these being, first, that the wet latex does not set up fast enough when using a progressive-type lasting machine to provide a permanent bond and the mechanical working of the latex to which it is subjected by forcing it through plumbing into a delivery nozzle and onto the surface of a feed roll causes it to deposit out of solution so that it accumulates excessively on the parts of the machine. The method of this invention is designed particularly to overcome these two obstacles. As a prerequisite to lasting with latex according to this method, the surface of the insole material to which the upper is to be lasted must be latex-receptive. According to the method herein disclosed, such receptivity is provided for by laminating a layer 10 of uncured rubber to a layer 12 of canvas, FIG. 6, and die-cutting the insoles therefrom or by applying a layer of rubber cement 14 to the insole material 16, FIG. 7, and die-cutting insoles therefrom.

The method is carried out on a progressive-type lasting machine such as shown in FIGS. 1, 4, 8 and 9 provided with a pair of cooperating, oppositely tapering, frustoconical feed rolls 18 and 20 between which the upwardly projecting lasting margin 22 at the bottom of the shoe is engaged and simultaneously advanced and pulled heightwise of the bottom and wiping instrumentalities comprising a fixed wiper blade 24 and a rotary wiper 26 for folding the upwardly stressed lasting margin into engagement with the bottom and pushing it inwardly. Such lasting and wiping instrumentalities are conventional in the art. The method of this invention is designed to enable using lasting apparatus of the aforesaid kind to achieve lasting with wet liquid latex, particularly in the manufacture of shoes having canvas uppers such as athletic shoes, tennis shoes and sneakers; however, it is to be understood that the method is not limited to fabric uppers nor exclusively to athletic-type footwear.

In order to achieve success according to this method, the latex must be delivered to the feed roll 18 without precipitating coagulation and thereafter while being carried by the feed roll around into contact with the lasting margin; it must be spread uniformly and partially coagulated so as to become adhesive. This is accomplished according to the method of this invention by delivering the latex in wet liquid form at a relatively low viscosity onto the surface of the feed roll 18 at approximately two-thirds the way around the roll from the place of tangency of the feed roll 18 with the lasting margin so as to provide an opportunity for the wet latex to spread over the surface and, while the latex is traveling around on the surface of the feed roll 18, projecting air toward the surface of the feed roll 18 at approximately one-quarter of the way around the roll from the place of tangency at a pressure such as to augment spreading and at a temperature such as to initiate coagulation and render the layer adhesive so that, when the layer reaches the point of tangency, the partially coagulated adhesive layer is transferred substantially entirely to the inner surface of the lasting margin, leaving the feed roll 18 clean of any adhesive latex. Air supplied at a pressure of 5 lbs. per square inch and at a temperature of 350° F suffices to effect the spreading and coagulation desired. The place of deposit of the adhesive to the surface of the feed roll 18 may be varied, depending upon the condition of the latex and the ambient conditions from two-thirds to one-half the way around the roll from the place of tangency.

The combination feeding and gripping rolls 18 and 20 are rotated at a constant speed and may be brought together at the moment the lasting margin is introduced between them or, if the operator is skilled, they may be set at a predetermined spacing. Upon introduction of the lasting margin between the feed rolls, the flow of latex to the feed roll 18 which also serves as an applicator roll is initiated by a treadle which the operator steps upon. The flow is controlled by an on/off valve which is opened and closed by a pneumatic cylinder, the operation of which is controlled by the treadle. It is seldom that the operator depresses and/or releases the treadle at the instant the lasting margin is introduced or at the instant it is removed and, consequently, after the work is removed, there will be a considerable amount of latex on the surface of the feed roll 18 which will then become transferred by rotation of the rolls 18 and 20 onto the surface of the feed roll 20. A portion of this is transferred to the outer side of the lasting margin during the next lasting operation and a portion accumulates on the surface of the feed roll sufficiently so that it may interfere with the proper operation of the apparatus, thus requiring that the apparatus be stopped and the coagulated latex removed. It was found and is, accordingly, part of the method of this invention that, by directing the jet of hot air toward the surface of the feed roll 18 at an angle such that a portion at least of the hot air is deflected toward the surface of the feed roll 20, that portion of hot air impinging upon the surface of the feed roll 20 in the absence of a lasting margin between the feed rolls produced a self-cleaning effect in that it dried out the wet adhesive, whereupon the dried adhesive dropped off the surface of the feed roll 20 in the normal course of operation without requiring that it be pulled off or that the machine be stopped to pull this dried adhesive away.

The method, therefore, according to this invention comprises essentially lasting to a latex-receptive insole by gravitationally delivering a wet, nontacky, nonadhesive, low-viscosity liquid latex onto the rotating surface of the feed roll, of a pair of feed rolls of the type used in a progressive lasting machine, having contact with the inner surface of the lasting margin at a place approximately two-thirds of the way around from the place of contact of the one feed roll, as the wet latex travels around from the place of delivery toward the place of contact, blowing heated air on the wet latex at a pressure such as to spread the latex smoothly on the surface of the roll and at a temperature such as to initiate coagulation and adhesiveness, at the place of contact with the lasting margin, pressing the partially coagulated adhesive latex onto the inner surface of the lasting margin, releasing the latex-coated lasting margin and pressing it into engagement with the latex-receptive surface of the insole.

The apparatus as already described comprises the oppositely tapering frustoconical feed rolls 18 and 20 and the wiping instrumentalities 24 and 26. For the purpose of delivering the wet latex on the surface of the feed roll 18, there is provided a nozzle 28 which is supported with its outlet 30 adjacent the surface of the inner feed roll 18 at a place substantially two-thirds of the way around the roll from the place of tangency thereof as shown in FIG. 9 by means of a ball assembly 32 shown in FIG. 4. The ball assembly 32 provides for adjustment to vary the position of the nozzle 28 from approximately two-thirds the way around the roll to one-half the way around and also to vary both the distance between the discharge cpening and the surface of the feed roll 18 and the heightwise position with reference to the top and bottom ends of the feed roll 18 according to the width of the lasting margin. A distance of approximately 1/32 to 1/16 inch between the tip 30 of the nozzle and the surface of the feed roll 18 has proved satisfactory; however, this distance may be varied depending upon the viscosity of the latex. The nozzle 28 is preferably gravitationally supplied with wet liquid latex through a conductor 34, one end of which is connected to the nozzle 28 and the other end of which is connected to the bottom of a container 36 closed at the top by a cover 38 so as to minimize contact of the air with the surface of the latex. The container 36 is provided with a vent 41 so that atmospheric pressure exists within it above the body of latex. Between the bottom of the container 36 and the nozzle, there is an on/off valve 40 which is shown in FIG. 5, provided by a bar 42 supported for movement toward and from a plate 44 mounted on a member secured to the machine frame. The bar 42 is pressure-operated by means of a pneumatic cylinder 46, valve V and treadle 48. Stop screws 50—50 are provided to prevent damage to the conductor 34. In addition to the on/off valve, there is volume control valve 52 which is provided with a hand-operated knob 54 to control the volume of flow and, when desirable, to shut off the flow entirely. For trouble-free delivery, the latex should be at a viscosity of 1000 to 4000 cps and the flow passages through conductor and nozzle should be approximately ⅛ and 3/16 of an inch in diameter. Otherwise, plugs of coagulated latex will develop too frequently within the passage which requires stopping the operation in order to pick the plugs out of the passages to free them for normal flow of the latex.

A second nozzle 56, FIG. 9, is mounted so as to direct a jet of air toward the surface of the feed roll 18 at a place between the nozzle 28 and the place of contact of the feed rolls with the lasting margin, preferably about one-quarter of the way around the feed roll 18 from the place of contact, at an angle so that the jet of air delivered therefrom is not only projected toward the surface of the feed roll 18, but partially deflected by that surface onto the surface of the lasting margin during the lasting operation and in the absence of the lasting margin onto the surface of the feed roll 20. The air is supplied to the nozzle 52 through a suitable valve 54 at a pressure such that the force of the jet assists in spreading the wet adhesive uniformly on the surface of the feed roll 18 and, for this purpose, a supplying pressure of approximately 5 lbs. per square inch is used. At the same time, the air is heated by means of a coil 56, the temperature of which is controlled by a rheostat R to heat the air to a temperature to initate coagulation and adhesiveness. A temperature on the order of 350° F is provided for this purpose.

It is within the scope of the invention to vary the distance of the nozzle 28 from two-thirds to one-half the way around from the place of contact and the nozzle 52 from one-quarter to one-third the way around from the place of contact, depending upon the viscosity of the wet liquid latex and the ambient conditions. Similarly, the pressure and temperature of the air may be varied between 2 to 10 lbs. per square inch and 200° to 400° F without departing from the intent and purpose of the invention.

Using the method described above and the apparatus described for carrying out the method, it is possible to achieve good lasting without using upper precementing or hot melt adhesives and without their disadvantages and also to maintain the apparatus by means of which the lasting is carried out clean and continuously operative.

It should be understood that the present disclosure is for the purpose of illustration only and includes all modifications or improvements which fall within the scope of the appended claims.

We claim:

1. The method of adhesively attaching the lasting margin of an upper to the latex-receptive bottom of a shoe with latex comprising progressively and uninterruptedly stretching successive increments of the lasting margin perpendicular to the bottom with the aid of a pair of oppositely turning gripping and feeding rolls, one of which has contact with the inner side of the lasting margin and the other with the outside of the lasting margin and then releasing the pressing the margin into engagement with the bottom with the aid of wiping means, said method comprising continually delivering wet liquid latex onto the rotating surface of said one feed roll at a place substantially two-thirds of the way around from the place of stretching in the direction opposite to rotation for transfer from the place of delivery to the lasting margin at the place of stretching, directing a jet of air toward the surface of said one feed roll at a place substantially one-quarter way around from the place of stretching in the direction opposite to rotation at a pressure such as to assist in spreading the liquid latex on the surface uniformly and at a temperature such as to cause it to partially coagulate and become adhesive and, at the place of stretching, pressing the partially coagulated adhesive layer of latex in engagement with the lasting margin, said method including continuously presenting uncoated areas of the lasting margin to the place of stretching, continuously supplying fresh portions of partially coagulated adhesive latex to said incremental uncoated areas as they are advanced to said place of stretching, releasing the uncoated margin and pressing the coated margin into engagement with the latex-receptive surface of the bottom.

2. The method according to claim 1 comprising providing at the bottom of the shoe an insole having at its margin, at least, a layer of unvulcanized rubber.

3. The method according to claim 1 comprising providing at the bottom of the shoe an insole comprised of a layer of canvas to which a layer of unvulcanized rubber has been laminated.

4. The method according to claim 1 comprising providing at the bottom of the shoe an insole to which a layer of rubber cement has been applied.

5. The method according to claim 1 wherein the liquid latex has a viscosity on the order of 1000 to 4000 cps.

6. The method according to claim 1 wherein the liquid has a viscosity of 2000 cps.

7. The method according to claim 1 wherein the liquid latex is delivered to the surface of said one feed roll in a nonadhesive form.

8. The method according to claim 1 wherein the latex is gravitationally delivered onto the surface of said one feed roll.

9. The method according to claim 1 wherein the air is projected onto the surface of said one feed roll at about 2 to 10 lbs. per square inch.

10. The method according to claim 1 wherein the air is projected onto the surface of the one feed roll at 5 lbs. per square inch.

11. The method according to claim 1 wherein the air is projected onto the surface of said one feed roll at a temperature of approximately 200° to 400° F.

12. The method according to claim 1 wherein the air is projected onto the surface of the one feed roll at a temperature of 350° F.

13. The method according to claim 1 comprising directing the jet of air toward the surface of said one of the feed rolls at a place on the surface traveling toward the place of contact with the lasting margin at an angle such that it is partially deflected toward the surface of said lasting margin.

14. Lasting apparatus for lasting footwear with latex comprising a pair of oppositely turning work gripping and feeding rolls of oppositely tapering frustoconical configuration supported for rotation about spaced parallel axes with their frustoconical surface spaced for receiving between them the lasting margin of a shoe upper, said gripping and feeding rolls being arranged so that one of the rolls has a downwardly divergent frustoconical surface for engagement with the inner side of the lasting margin and fixed and rotating wipers at the delivery side of the gripping and feeding rolls for folding the lasting margin downwardly as it is released from the gripping and feeding rolls and for pushing the folded margin inwardly parallel to the surface of the bottom, nozzle means for gravitationally delivering wet, nontacky, nonadhesive liquid latex onto the surface of said one feed roll at a place substantially two-thirds of the way around from the place of engagement of said one feed roll, with the inner side of the lasting margin, and means for spreading and rendering said wet liquid latex partially coagulated and adhesive before it reaches said place of engagement.

15. Apparatus according to claim 14 comprising means for adjusting the position of said nozzle means relative to the upper and lower ends of the feed rolls.

16. Apparatus according to claim 14 comprising means for adjusting the position of said nozzle means peripherally of said one feed roll.

17. Apparatus according to claim 14 wherein said last means comprises second nozzle means arranged to project air toward the surface of said one feed roll at approximately one-quarter of the way around from the place of engagement at a predetermined pressure and temperature.

18. Apparatus according to claim 17 comprising supplying the air to the second nozzle means at a pressure of 2 to 10 lbs. per square inch and at a temperature of 200°-400° F.

19. Apparatus according to claim 17 comprising supporting the second nozzle means at an angle such that a part at least of the jet of air is directed toward the surface of the lasting margin and the other feed roll.

20. Apparatus according to claim 14 wherein said nozzle contains a flow passage of approximately ⅛ and 3/16 inch in diameter and there is means for adjustably supporting it adjacent the surface of said one feed roll for movement both heightwise and peripherally thereof.

21. Apparatus according to claim 14 wherein there is a container for the latex, a conductor connected at one end to the container and at the other end to the nozzle for gravitationally conducting the latex to the nozzle and an actuatable valve to start and stop the flow of latex to the nozzle.

22. Apparatus according to claim 14 wherein there is a container for the latex, a conductor connected at one end to the container and at the other end to the nozzle for gravitationally conducting the latex to the nozzle and a flow control valve for controlling the volume of flow.

23. Apparatus according to claim 14 wherein there is means for supporting said second nozzle means for adjustment relative to the feed rolls and adjustable means for varying the air pressure and temperature of the air delivered thereby to the feed rolls.

* * * * *